US011673701B2

(12) United States Patent
Schmuker et al.

(10) Patent No.: US 11,673,701 B2
(45) Date of Patent: Jun. 13, 2023

(54) PACKAGING MACHINE AND METHOD FOR PACKAGING PACKAGE GOODS

(71) Applicant: Uhlmann Pac-Systeme GmbH & Co. KG, Laupheim (DE)

(72) Inventors: Markus Schmuker, Frankenhofen (DE); Harald Mauz, Ehingen (DE)

(73) Assignee: PAC-SYSTEME GMBH & CO. KG, Laupheim (DE)

( * ) Notice: Subject to any disclaimer, the term of this patent is extended or adjusted under 35 U.S.C. 154(b) by 42 days.

(21) Appl. No.: 17/308,781

(22) Filed: May 5, 2021

(65) Prior Publication Data

US 2021/0347512 A1 Nov. 11, 2021

(30) Foreign Application Priority Data

May 8, 2020 (EP) ..... 20173735

(51) Int. Cl.
*B65B 57/10* (2006.01)
*B65B 57/18* (2006.01)
(Continued)

(52) U.S. Cl.
CPC ..... *B65B 57/10* (2013.01); *B65B 57/02* (2013.01); *B65B 57/18* (2013.01); *B65B 43/145* (2013.01); *B65B 61/20* (2013.01)

(58) Field of Classification Search
CPC ..... B65B 43/126; B65B 43/145; B65B 57/02; B65B 57/10; B65B 57/18; B65B 61/20;
(Continued)

(56) References Cited

U.S. PATENT DOCUMENTS 2,865,154 A * 12/1958 Coyne ..... B65B 61/20 53/74
4,179,113 A * 12/1979 Gallimore ..... B65B 61/20 271/166
(Continued)

FOREIGN PATENT DOCUMENTS

DE 2924428 12/1980
DE 202007015041 3/2008
(Continued)

OTHER PUBLICATIONS

European Search Report dated Oct. 9, 2020, for application EP20173735.

*Primary Examiner* — Stephen F. Gerrity
(74) *Attorney, Agent, or Firm* — Dickinson Wright PLLC

(57) ABSTRACT

The packaging machine comprises a supply unit for holding and providing a plurality of package goods or packaging materials. A display device assigned to the supply unit is configured to display at least one optical marking, which is indicative of a fill level of the supply unit and is different from an alphanumeric display. The at least one optical marking is variably adaptable as a result of at least one process parameter different from the fill level in a way that an assignment of the at least one optical marking to a certain degree of the fill level of the supply unit is changeable. A control unit, which communicates with the display device, is configured to adapt the at least one optical marking as a function of the at least one process parameter different from the fill level.

15 Claims, 2 Drawing Sheets

(51) Int. Cl.
*B65B 57/02* (2006.01)
*B65B 43/14* (2006.01)
*B65B 61/20* (2006.01)

(58) Field of Classification Search
CPC B65B 5/00; B65B 5/103; B65B 17/00; B65B 35/02; B65B 35/12; B65B 41/02; B65B 57/00; B65H 7/04
USPC ..... 53/396, 52, 507, 508; 271/258.04
See application file for complete search history.

(56) References Cited

U.S. PATENT DOCUMENTS

| | | | | |
|---|---|---|---|---|
| 7,299,103 | B1 * | 11/2007 | Dye | B65B 57/02 700/171 |
| 2005/0252172 | A1 * | 11/2005 | Herzog | H05B 6/06 53/DIG. 2 |
| 2014/0311093 | A1 * | 10/2014 | Huber | B65B 57/02 53/131.2 |
| 2015/0030417 | A1 * | 1/2015 | Boehm | B65B 57/02 53/507 |
| 2018/0029735 | A1 * | 2/2018 | Franzaroli | B65B 57/02 |
| 2020/0156915 | A1 * | 5/2020 | Hofmann et al. | B65B 57/00 |
| 2020/0385223 | A1 * | 12/2020 | Witkoe | B65H 7/04 |

FOREIGN PATENT DOCUMENTS

| | | | | | |
|---|---|---|---|---|---|
| DE | 102012101114 | | | 8/2013 | |
| DE | 102012004565 | | | 9/2013 | |
| EP | 3594139 | | | 1/2020 | |
| JP | 57160844 | A | * | 10/1982 | B65H 7/04 |
| JP | 58002147 | A | * | 1/1983 | B65H 7/04 |
| JP | 60052440 | A | * | 3/1985 | B65H 7/04 |

* cited by examiner

PACKAGING MACHINE AND METHOD FOR PACKAGING PACKAGE GOODS

CROSS-REFERENCE TO RELATED APPLICATIONS

This application claims the benefit of priority under 35 U.S.C. § 119 to European Patent Application No. 20 173 735.0, filed May 8, 2020, the contents of which is incorporated herein by reference in their entirety.

FIELD

The present disclosure relates to a packaging machine and to a method for packaging package goods in appropriate packaging materials.

BACKGROUND

Packaging machines such as blister pack machines or cartoning machines usually comprise storage units for holding packaging materials (e.g., folding boxes, cartons, etc.) or package goods (e.g., pharmaceutical products, package inserts, or prospectuses). We have discovered that when the operator of the machine needs to refill the storage unit during the packaging process, he/she will not be able to see the display on, for example, the man-machine interface (MMI). Various process parameters shown to the operator on the display are therefore unavailable to the operator at least for a certain period of time.

The operator therefore receives no information on when the batch just then being processed is near an end or on how many package goods or packaging materials will be required to finish the batch. In addition, the level to which the supply unit is filled with various packaging materials or package goods is not easy to determine visually. For the sake of optimizing operations as much as possible, the operator must be able to estimate these and other variables. A great deal of experience is required to do this.

Incorrect estimates and lack of experience can, for example, have the result that the supply unit is still full at the end of the processed batch. This means that the supply unit must be emptied, which increases the amount of work to be done. In addition, repeatedly filling and emptying the supply unit can cause damage to the packaging materials or package goods, which can have a negative effect on their quality and can also have a disadvantageous effect on the reliability of the packaging machine.

A packaging machine, furthermore, can comprise a processing unit, the function of which depends on the level of packaging materials or package goods in the supply units. For example, a pull-off extractor for removing prospectus sheets, package inserts, etc, can be provided, the function and reliability of which depend on the height of the stack of prospectus sheets, packaging inserts, etc., present in the supply unit and which thus depend in turn on the experience of the operator. Another example is a hopper for delivering pharmaceutical products, the function and reliability of which depend on the level of pharmaceutical products present in the hopper and thus again on the experience of the operator.

SUMMARY

It is an object of the present disclosure to provide a packaging machine and a method for packaging package goods in appropriate packaging materials, which packaging machine and method reduce the operator's work load and make it possible for the operator to detect, simply and reliably, the level of goods or materials present in a supply unit of the packaging machine.

According to an aspect of the disclosure, the packaging machine for packaging package goods in packaging materials comprises a supply unit for holding and providing a plurality of package goods or packaging materials. A display device, which is assigned to the supply unit and is configured to display at least one optical marking. The at least one optical marking is different from an alphanumeric display and is indicative of a fill level of the storage unit. The at least one optical marking is variably adaptable as a function of at least one process parameter different from the fill level in a way that an assignment of the at least one optical marking to a certain degree of the fill level of the supply unit is changeable. A control unit, which communicates with the display device, is configured to adapt the at least one optical marking as a function of the at least one process parameter different from the fill level.

In this way a packaging machine is provided, for which the operator can detect the fill level of the supply unit quickly and easily on the basis of the at least one optical marking. Because the optical marking can also be adapted in various ways, it can be adapted by means of the control unit to a process parameter different from the fill level, e.g. to a parameter such as the format, the associated weight or packing density of the package goods or packaging materials in the supply unit, or to the batch size, to the output, or to an optimal operating point of a system of the packaging machine assigned to the supply unit. The operator is thus supported, and the value of the operator's experience becomes less vital. The efficiency of the packaging machine and the quality of the packaging process can thus be increased in a manner substantially independent of the operator's experience.

Because the at least one optical marking is adaptable in various ways as a function of the at least one process parameter different from the fill level, the term "process parameter" should always be understood as a "process parameter different from the fill level", unless explicitly designated otherwise.

The packing density of the plurality of package goods or packaging materials is defined generally herein as the number of package goods or packaging materials per unit length (e.g., stated in units/mm).

When the phrase "package goods or packaging materials" is used herein, reference is being made to the items present in the supply unit in the case in question, i.e., either to package goods or packaging materials. If package goods are present in the supply unit, then the expression "package goods or packaging materials" refers to package goods. If packaging materials are present in the supply unit, however, the expression then refers accordingly to packaging materials.

In the packaging machine, package goods are packaged in appropriate packaging materials. Packaging materials can be, for example, folding boxes, cartons, or other types of containers. Package goods can be, for example, products designed to be packaged, in particular pharmaceutical products, package inserts, and prospectuses.

A production lot, a packaging lot, a series, or a run is referred to here as a "batch".

A packaging machine can also comprise one or more additional supply units, to each of which an additional display device preferably can be assigned and which can hold different types of package goods or packaging materials.

The packaging machine is preferably a blister pack machine or a cartoning machine. The supply unit is preferably a folding box magazine for holding and providing a plurality of folding boxes or a prospectus storage unit for holding and providing a plurality of prospectuses or package inserts. The supply unit can also be a magazine for holding and providing a plurality of cartons in a cartoning machine.

The at least one optical marking indicative of the fill level of the supply unit can indicate the absolute fill level of the supply unit; that is, it can show, for example, whether or not the supply unit is empty or full; or it can show, for example, a relative fill level of the supply unit and thus, for example, indicate the number of package goods or packaging materials in the supply unit relative to the output of the packaging machine, relative to the package goods or packaging materials required for a batch to be processed, or relative to an optimal degree of filling of the supply unit. The terms "degree of filling" and "fill level" are substantially synonymous.

The control unit is configured to actuate the at least one optical marking and especially to actuate it as a function of the fill level of the supply unit. The control unit can, for example, turn the optical marking on or off and/or actuate it in such a way that it changes a certain property such as its color.

An optical marking capable of variable adaptation is, herein, a marking such that the assignment of the marking to a certain fill level of the supply unit can be changed. In particular, this assignment can be adapted, i.e., therefore, varied, as a function of at least one process parameter different from the fill level.

For example, the optical marking can indicate that a supply unit is almost empty, i.e., that the fill level is close to the "empty" point. Now, if the packaging machine is being operated at a first output rate, the optical marking can be arranged a certain first distance away from the end of the supply unit from which the packaging materials or package goods are taken. The optical marking is therefore assigned to a first fill level which corresponds to the first distance. If, however, the packaging machine is being operated at a second output rate which is higher than the first output rate, the optical marking can be arranged at a second distance from the end of the supply unit from which the packaging materials or package goods are taken, wherein the second distance is greater than first distance. The optical marking is then assigned to a second fill level, which corresponds to the second distance. The process parameter different from the fill level corresponds in this case to the output rate of the packaging machine, and the optical marking is adapted as a function of the output rate, in that it is assigned to the second fill level instead of to the first fill level. At the higher output rate, the operator is thus informed sooner that the supply unit is almost empty, and, in spite of the higher output rate, there remains sufficient time to refill the supply unit.

In addition to the actuation of the at least one optical marking, the control unit is therefore also configured to adapt the at least one optical marking as a function of the at least one process parameter different from the fill level. The optical marking capable of variable adaptation is actuated as appropriate by the control unit to produce the adaptation. What is in question here is therefore preferably an optical marking which can be adapted substantially automatically. The operator can, in certain cases, intervene by the use of an input device connected to the control unit. It is possible, for example, to adapt an optical characteristic of the marking such as its color or intensity, to adapt the dimensions or the shape of the marking, or to adapt a change (in the color) of the marking.

In particular, an optical marking is not to be understood as an alphanumeric display. Alphanumeric displays cannot be read out quickly, and it can simply be difficult to read them; they usually lack a relationship to the packaging process or to the process parameters, which in any case are displayed separately. For example, the mere display of the number of packaging material units or package good units present in the supply unit has little relevance in itself without a relationship to the packaging process, and the evaluation of the display thus depends on the operator and his experience. The at least one display device is therefore not an alphanumeric display. Instead, the display device is configured to show at least one optical marking different from an alphanumeric display. In general, the display device will preferably be configured as a device separate from an input device or an MMI.

In an especially preferred embodiment, the at least one optical marking is a color marking, the color or color progression of which can be adapted as a function of the at least one process parameter different from the fill level. The display device can then comprise a color marking or several color markings. For example, the color marking can comprise a plurality of different colors, which are substantially separate from each other or which blend continuously into each other and thus form a color progression. A certain fill level of the supply unit can, for example, be assigned to a color. This assignment can be varied, so that a marking capable of variable adaptation is obtained. For example, the color or the color progression can be adapted as a function of the format or of the packing density of the package goods or packaging materials in the supply unit, as described herein.

The display device is preferably arranged on or in the supply unit. The display device is preferably arranged in an area which can be easily seen by the operator of the packaging machine, in particular an area which can be seen while this operator is filling the supply unit. The display device is therefore preferably not attached to the MMI or formed by the MMI but rather is configured as a device separate from an input device or the MMI.

The display device, however, can also be arranged a certain distance away from the supply unit. In this case as well, it should be possible for the operator to see it easily, especially while he is filling the supply unit.

In one embodiment, the display device or at least the optical marking is arranged along the plurality of package goods or packaging materials in the supply unit. The at least one optical marking can, at least partially, be in contact with the package goods or packaging materials or in immediate proximity to them, so that the marking and the package goods or packaging materials can be detected jointly by the operator. As a result, the fill level of the supply unit can be quickly and easily detected by looking at the package goods or packaging materials in the supply unit.

To facilitate a reliable read-out, the display device or at least the optical marking can be partially covered by the plurality of package goods or packaging materials. It can therefore be seen directly how far the plurality of package goods or packaging materials in the supply unit extend along the optical marker.

The display device or the at least one optical marking can, for example, be configured as a light strip. A light-emitting strip can comprise a light-emitting field or a plurality of light-emitting fields, in particular a plurality of LEDs. If the light-emitting fields of the plurality of light-emitting fields are individually actuatable, the light-emitting strip forms a corresponding plurality of optical markings. A light-emitting strip, which can also be referred to in general as a light-emitting band, can be very easily attached so that it extends along the plurality of package goods or packaging materials in the supply unit and optionally can be partially covered by the plurality of package goods or packaging materials.

The light-emitting strip does not necessarily have to comprise individually actuatable light-emitting fields, but individually actuatable light-emitting fields offer the advantage that the optical markings they form are configured so that they can be adapted variably in an especially easy manner. For example, each light-emitting field can be turned on or off independently of the other light-emitting fields, or the individual light-emitting fields can have different colors, which are easy to change and thus can be adapted in any way desired.

An optical marking, preferably in the form of a light-emitting strip, arranged along the plurality of package goods or packaging materials can, for example, comprise a first color (e.g., green) in an area of the supply unit in which package goods or packaging materials are arranged only when the supply unit is sufficiently full. This depends on the format of the package goods or packaging materials and their packing density in the supply unit. If, in a different packaging process, the supply unit holds different package goods or packaging materials, the section of the optical marking which has the first color can be adapted as appropriate as a function of the format or packing density of the products or materials.

If, for example, the package goods or packaging materials are thinner or have a greater packing density, the section of the optical marking with the first color can be arranged closer to one end of the supply unit, i.e., the end at which the package goods or packaging materials are taken from the supply unit for further processing. In the case of thicker package goods or packaging materials or in the case of lower packing densities, fewer package goods or packaging materials are present over the same length. For this reason, the section of the optical marking with the first color should then be arranged farther away from this end of the supply unit.

In similar fashion, the optical marking can have a second color (e.g., red) in an area near one end of the supply unit, i.e., the end at which the package goods or packaging materials are taken from the supply unit for further processing, to indicate that the supply unit is almost empty. The section of the optical marking with the second color can also be adapted as appropriate as a function of a process parameter independent of the fill level such as the format or the packing density.

If the display device comprises a light-emitting strip extending along the supply unit, an appropriate color, for example, can be easily assigned to each section.

In one embodiment, the at least one optical marking can be projected onto the plurality of package goods or packaging materials. It is also possible in this way for the fill level of the supply unit to be especially quickly and easily detected simply by looking at the package goods or packaging materials in the supply unit. The optical marking, furthermore, can be easily adapted as a function of the at least one process parameter.

In an alternative embodiment, the display device is configured as an optical signal device, in particular as a "traffic signal", or a signal column on the supply unit. The optical signal device preferably comprises a plurality of optical markings, especially in the form of separate light-emitting fields. These light-emitting fields can, for example, be arranged one above the other. The optical signal device can be configured to display two or more (fill) states of the plurality of package goods or packaging materials in the supply unit.

In one embodiment, the optical signal device is configured to indicate a fill level of the supply unit in the form of the height of a stack of package goods or packaging materials, especially of prospectuses or package inserts. In a different exemplary embodiment, the optical signal device can be configured to indicate a fill level of the supply unit in the form of a quantity of package goods, especially of pharmaceutical products.

The process parameter different from the fill level can, for example, be an optimum operating point of a removal device assigned to the supply unit (e.g., a pull-off extractor). The optimum operating point can in turn depend on the type and material of the packaging materials or package goods present in the supply unit, or on the extraction speed of the pull-off extractor. When a first packaging material is being used, the optimum operating point can thus correspond, for example, to a first stacking height, to which the at least one optical marking is assigned; whereas, when a second packaging material is being used, the optimum operating point corresponds to a second stacking height, to which the at least one optical marking is assigned. As a result, the at least one optical marking is adapted as a function of the optimum operating point independently of the actual fill level of the supply unit.

The optical signal device can comprises a first light-emitting field, which is turned on when the height of the stack corresponds to a predefined optimum height and thus to a first fill level, of which it is indicative. If the height of the stack deviates from the optimum height but is still with a certain tolerance range, a second light-emitting field of the optical signal device can be turned on. The second light-emitting field is therefore assigned to a height within the tolerance range and indicates this. If the height of the stack is outside the tolerance range, a third light-emitting field of the optical signal device, finally, can be turned on, this field being assigned to a height outside the tolerance range, which it indicates. The second light-emitting field thus makes it possible to give the operator advance warning, and the third light-emitting field tells the operator that action is necessary. It is also conceivable that only two light-emitting fields could be provided, which signal whether or not the height of the stack is within or outside the tolerance range.

The supply unit can also be formed by a hopper, which simultaneously forms a feed device for the package goods (e.g. pharmaceutical products) present in it and thus also forms a removal device directly assigned to the supply unit. The process parameter different from the fill level can then be, for example, an optimum operating point of the hopper. Thus, when a first type of package good is being packaged, the optimum operating point can, for example, correspond to a first fill level in the hopper, to which the at least one optical marking is assigned; whereas, when a second type of package good is being packaged, the optimum operating point corresponds to a second fill level in the hopper, to which the at least one optical marking is assigned. As a result, the at least one optical marking is adapted as a function of the optimum operating point independently of the actual fill level of the supply unit. The optical signal device can be configured in a manner similar to that of the preceding exemplary embodiment.

The at least one process parameter different from the fill level preferably corresponds to a format of the plurality of package goods or packaging materials and/or to a packing density of the plurality of package goods or packaging materials in the supply unit.

The packaging machine preferably comprises a sensor, which communicates with the control unit and which is configured to determine the at least one process parameter different from the fill level. The control unit is configured to adapt the at least one optical marking as a function of this determined process parameter.

In addition or as an alternative, at least one process parameter different from the fill level can also be called up from a database, which is in communication with the control unit. Process parameters such as a batch size or an output rate of the packaging machine but also the format of the plurality of package goods or packaging materials or an optimum operating point of the removal device can be stored in the database.

The packaging machine can also comprise an input device, in particular a man-machine interface (MMI), which is configured to select process parameters from the database or to input process parameters, especially relevant empirical values, and/or to store these in the database. The input device is preferably in communication with the control unit and the database. This makes it possible for the operator to intervene, and it is possible to profit from the experience of the operator of the packaging machine.

For example, all of the process parameters of the packaging machine different from the fill level described herein can be linked to the package good to be packaged, in particular to the type of package good to be packaged or to the designation of the (pharmaceutical) product to be packaged, and these parameters can be stored in the database. The operator can select the appropriate process parameters by, for example, entering the type or designation of the package good.

According to an aspect of the disclosure, a method for operating a packaging machine for packaging package goods in appropriate packaging materials comprises the steps of:

(a) providing a plurality of package goods or packaging materials in a supply unit of the packaging machine;

(b) displaying at least one optical marking, which is different from an alphanumeric display, by means of a display device, wherein the at least one optical marking is indicative of a fill level of the supply unit, and wherein the at least one optical marking is variably adaptable as a function of at least one process parameter different from the fill level in a way that an assignment of the optical marking to a certain degree of the fill level of the supply unit is changeable;

(c) determining the at least one process parameter different from the fill level; and (d) adapting the at least one optical marking as a function of the at least one determined process parameter different from the fill level.

In this way, a method is provided by means of which the optical marking is adapted automatically to at least one process parameter different from the fill level such as, for example, the format or the packing density in the supply unit or the batch size or the output rate of the packaging machine. The operator is thus supported, and the value of his experience is less vital. The efficiency of the packaging machine and the quality of the packaging process can thus be increased substantially independently of the experience of the operator.

This method serves preferably to operate a packaging machine as described before. All of the features pertaining to the packaging machine can be carried over to the method and vice versa, in most cases independently of the specific embodiment of the packaging machine.

Step (c) of the method preferably comprises detecting the at least one process parameter different from the fill level by means of a sensor, calling-up the at least one process parameter different from the fill level from a database, or entering the at least one process parameter different from the fill level by the use of an input device. If step (c) comprises determining several process parameters, it is also possible for at least one of these process parameters to be detected by means of a sensor and/or for at least one additional process parameter to be called up from the database and/or for at least one additional process parameter to be entered by the operator. The calling-up of a process parameter from the database is preferably accomplished by the control unit and/or by means of an input device (MMI).

If the calling-up of a process parameter from the database is carried out by the operator (for example, by means of the input device), this can be done in that the operator inputs the designation of the type of package good or the designation of the package good (for example, of a pharmaceutical product), and the control unit calls up one or more corresponding process parameters independent of the fill level which are linked to this designation. Step (c) of the method comprises, in this case, entering a designation of the package good or of the product to be packaged by the operator and calling-up at least one process parameter linked to this designation from the database by the control unit.

The optical marking is preferably assigned to a specific degree of the fill level, of which it is indicative, and step (d) comprises the changing of the assignment of the optical marking to a specific degree of the fill level.

The method can comprise the successive repetition of steps (c) and (d) to adapt the at least one optical marking successively to the at least one process parameter different from the fill level during the packaging process.

For example, the method can comprise the step of determining the approaching end of a batch and then the step of adapting the at least one optical marking.

It is also conceivable, however, that steps (c) and (d) could be executed only at the beginning of the packaging process and no longer carried out thereafter, i.e., while the batch is being processed, during which time the optical marking remains in its adapted state and is then only dependent on the fill level as such.

In addition to the previously described process parameters different from the fill level, namely, the format of the plurality of package goods or packaging materials, the packing density of the plurality of package goods or packaging materials in the supply unit, and the optimum operating point of a removal device assigned to the supply unit, the at least one process parameter can also correspond to a batch size, to the number of package goods or packaging materials still needed for a batch, or to an output rate of the packaging machine.

In a preferred embodiment, the method comprises, in step (c), determining a first number of package goods or packaging materials corresponding to the holding capacity of the supply unit, and then determining a second number of package goods or packaging materials still needed for the batch to be processed by the packaging machine at the time in question. The method can also comprise, preferably in step (d), comparing the first number of package goods or packaging materials with the second number of package goods or packaging materials and adapting the at least one optical marking when the second number of package goods or packaging materials is less than or equal to the first number of package goods or packaging materials. For example, the at least one optical marking can in this case change color or blink. Thus the operator of the packaging machine is given a signal that the package goods or packaging materials already present in the supply unit are sufficient for the batch, and that no additional package goods or packaging materials need to be added.

It is obvious that step (d), additionally or alternatively, can comprise adapting the at least one optical marking when the first number of package goods or packaging materials is less than the second number of package goods or packaging materials in order to give the operator the signal that more package goods or packaging materials need to be added to the supply unit for this batch.

In one embodiment, step (c) comprises determining an optimum operating point of a removal device assigned to the supply unit. The optimum operating point is preferably in the form of the height of the stack of package goods or packaging materials which is optimal for processing. A tolerance range is also preferably entered. The method then also comprises, in step (d), adapting the at least one optical marking by assignment of the optical marking to the determined operating point and/or to the tolerance range.

DETAILED DESCRIPTION

Figure 1:
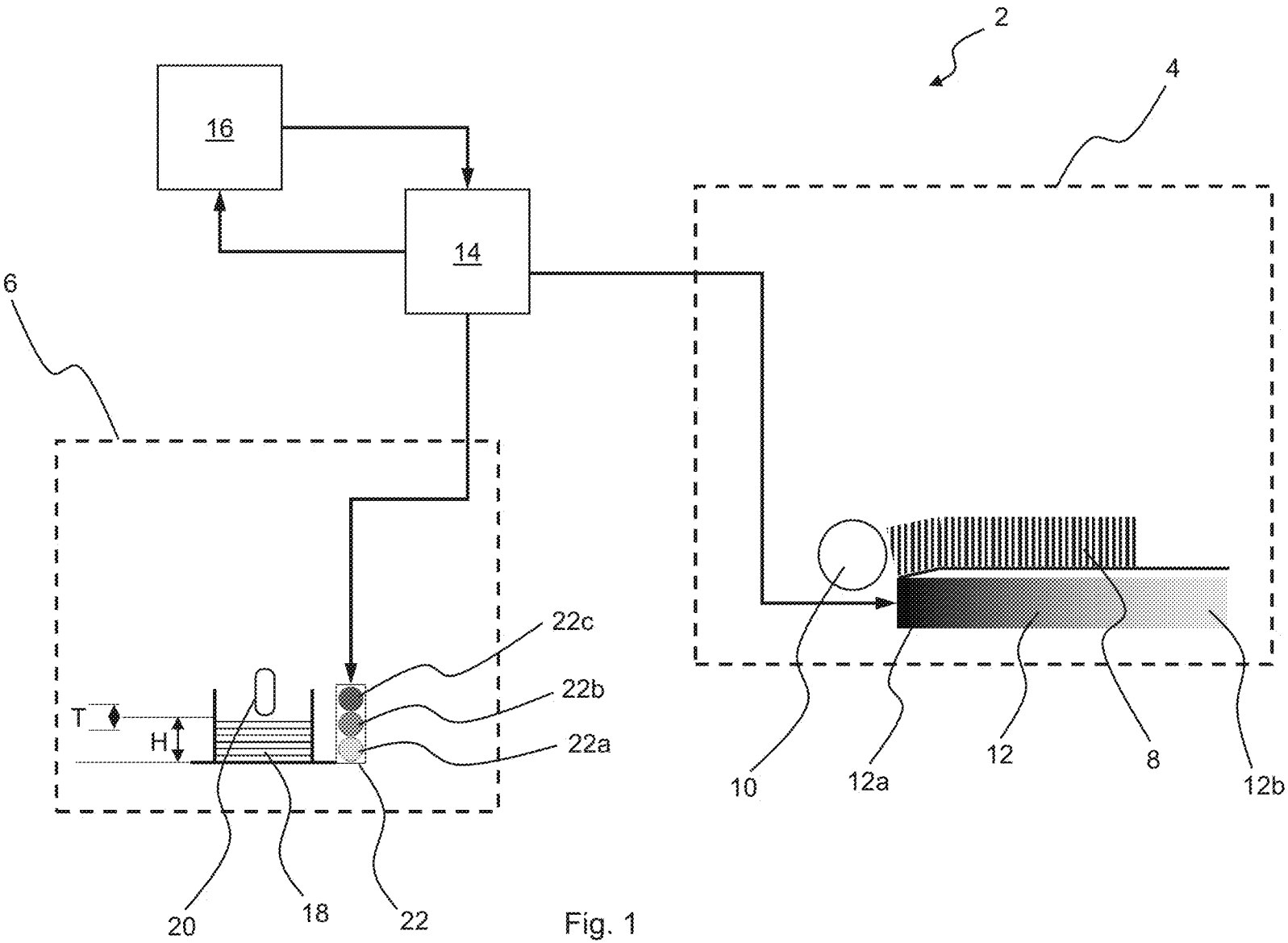
FIG. 1 shows a schematic diagram of the essential components of a first embodiment of a packaging machine according to the disclosure.

FIG. 1 shows a schematic diagram of a first embodiment of a packaging machine 2 according to the disclosure. By way of example—for the purpose of explaining the various embodiments—the illustrated packaging machine 2 comprises a first supply unit 4 and a second supply unit 6. The first supply unit 4 is configured as, for example, a drop-shaft magazine, and the second supply unit 6 is configured as a prospectus feeder. It is obvious that the packaging machine 2 could also comprise only one of the two supply units 4, 6 or additional supply units and that each of the supply units could also be provided with different package goods or packaging materials.

The first supply unit 4 holds a plurality of package goods or packaging materials 8, here a plurality of folding boxes or folding box blanks 8, and makes them available for further processing. For this purpose, the top-most folding box 8 is pulled off from the first supply unit 8 by means of, for example, a removal device 10, which is merely suggested in FIG. 1.

The packaging machine 2 comprises a first display device 12, which is assigned to the first supply unit 4 and which is configured to display at least one optical marking. In the exemplary embodiment shown here, the optical marking is a color marking extending along the packaging materials 8, so that the first display device 12 has a first color at a first end 12*a* and a second color at a second end 12*b*. Between the first and second ends 12*a*, 12*b*, the first display device 12 shows a continuous, progressive change of color.

The optical marking is indicative of the fill level of the supply unit 4. For this purpose, the first color signals the operator that the first supply unit 4 is empty or almost empty, and the second color signals the operator that the first supply unit 4 is full.

The first display device 12 is arranged in the first supply unit 4. The first display device 12 extends along the plurality of packaging materials 8 and is configured as, for example, a light-emitting strip.

The packaging machine 2 also comprises a control unit 14. The control unit 14 communicates with the first display device 12 and is configured to adapt the at least one optical marking of the first display device 12 as a function of at least one process parameter different from the fill level.

In the machine according to FIG. 1, there exists the possibility, for example, of adapting the color progression of the first display device 12 as a function of the format of the packaging materials 8, of the packing density of the packaging materials 8 in the supply unit 4, or of the output rate of the packaging machine 2 as the process parameter.

If the first supply unit 4 holds packaging materials or package goods 8 which are thicker than those of the illustrated exemplary embodiment or if the packaging materials or package goods 8 in the first supply unit 4 are arranged with a lower packing density (units/millimeter), these are used up more quickly at the same output rate. Correspondingly, the optical marking of the first display device 12 could be adapted in such a way that it signals an empty or almost empty supply unit 4 at a point located farther in the direction of the second end 12*b* of the first display device 12.

If, on the other hand, the output rate, as the process parameter of the packaging machine 2, is increased but the same package goods or packaging materials 8 being processed remain the same, again a corresponding adaptation of the optical marking of the first display device 12 is useful, because the package goods or packaging materials 8 in the supply unit are used up more quickly.

It is also conceivable that the first display device 12 could, instead of a color progression, comprise a plurality of separate light-emitting or color fields, each of which forms an optical marking. The light-emitting or color fields can be adjacent to each other or arranged at certain points a certain distance apart along the package goods 8.

The packaging machine 2 also comprises an input device or a man-machine interface (MMI) 16, which communicates with the control unit 14. The input device 16 comprises input means for entering process parameters or empirical values by the operator. In addition, an MMI can also comprise a display for showing process parameters.

The second supply unit 6 holds a plurality of package goods or packaging materials 18, here a plurality of prospectuses 18, and provides these for further processing. For example, a removal device assigned to the second supply unit 6 is configured in this case as a pull-off extractor 20, and, in each case, the top-most prospectus 18 is pulled off by the extractor 20 and delivered to the next step of the process.

The packaging machine 2 comprises a second display device 22, which is assigned to the second supply unit 6 and which is configured to display at least one optical marking. The second display device 22 also communicates with the control unit 14.

In the exemplary embodiment shown, the second display device 12 is configured as a "traffic signal", which comprises a first optical marking 22*a*, a second optical marking 22*b*, and a third optical marking 22*c*. The first, second and third optical markings 22*a*, 22*b*, 22*c* are preferably arranged one above the other. Instead of a traffic signal, it would also be possible to use, for example, a signal column.

The first optical marking 22*a* preferably comprises a first color, the second optical marking 22*b* a second color, and the third optical marking 22*c* a third color.

The optical markings 22*a*, 22*b*, 22*c* are indicative of the fill level of the second supply unit 6. For example, the first color tells the operator that the second supply unit 6 is sufficiently filled, and the third color tells the operator that the second supply unit 6 is empty or almost empty. The second color can indicate an intermediate state, i.e., a certain amount of progress toward an empty supply unit 6.

Similarly to what has been described above, at least one optical marking of the second display device 22 can, for example, be adapted as a function of the format of the package goods 18, of the packing density of the package goods 18 in the second supply unit 6, or of the output rate of the packaging machine 2 as the process parameter. As a result of an increase in the output, for example, a switchover from the first to the second optical marking 22*a*, 22*b* and from the second to the third optical marking 22*b*, 22*c* can take place sooner, i.e., at a point when the number of package goods 18 in the second supply unit 6 is larger and therefore when the fill level is higher. As part of the adaptation process, each of the optical markings 22*a*, 22*b*, 22*c* can thus be assigned to, for example, a different specific fill level of the supply unit 6.

It is also conceivable that the pull-off extractor 20 could operate flawlessly at an optimum operating point, e.g., at an optimum height H of the stack of prospectuses 18 in the second supply unit 6, but that the reliability of the extractor 20 would decrease when there are deviations from the optimum operating point. Correspondingly, the first optical marking 22*a* can be assigned to a fill level which corresponds to a stack with the optimum height H. A tolerance range T, furthermore, can be determined, within which the extractor 20 works with sufficient quality and reliability. The second optical marking 22*b* can be assigned in that case to a fill level which lies within the tolerance range T. A fill level of the second supply unit 8 outside the tolerance range T can be indicated by the third optical marking 22*c*, which is assigned to this type of fill level.

The optimum operating point can, for example, depend on the type and material of the package goods 18, on the output rate of the packaging machine 2, and on the associated extraction rate of the extractor 20 as process parameters. Each optical marking 22*a*, 22*b*, 22*c* can therefore be adapted as a function of at least one process parameter, in that it is assigned, for example, to a different height H, and the time at which it is actuated is adapted accordingly.

Figure 2:
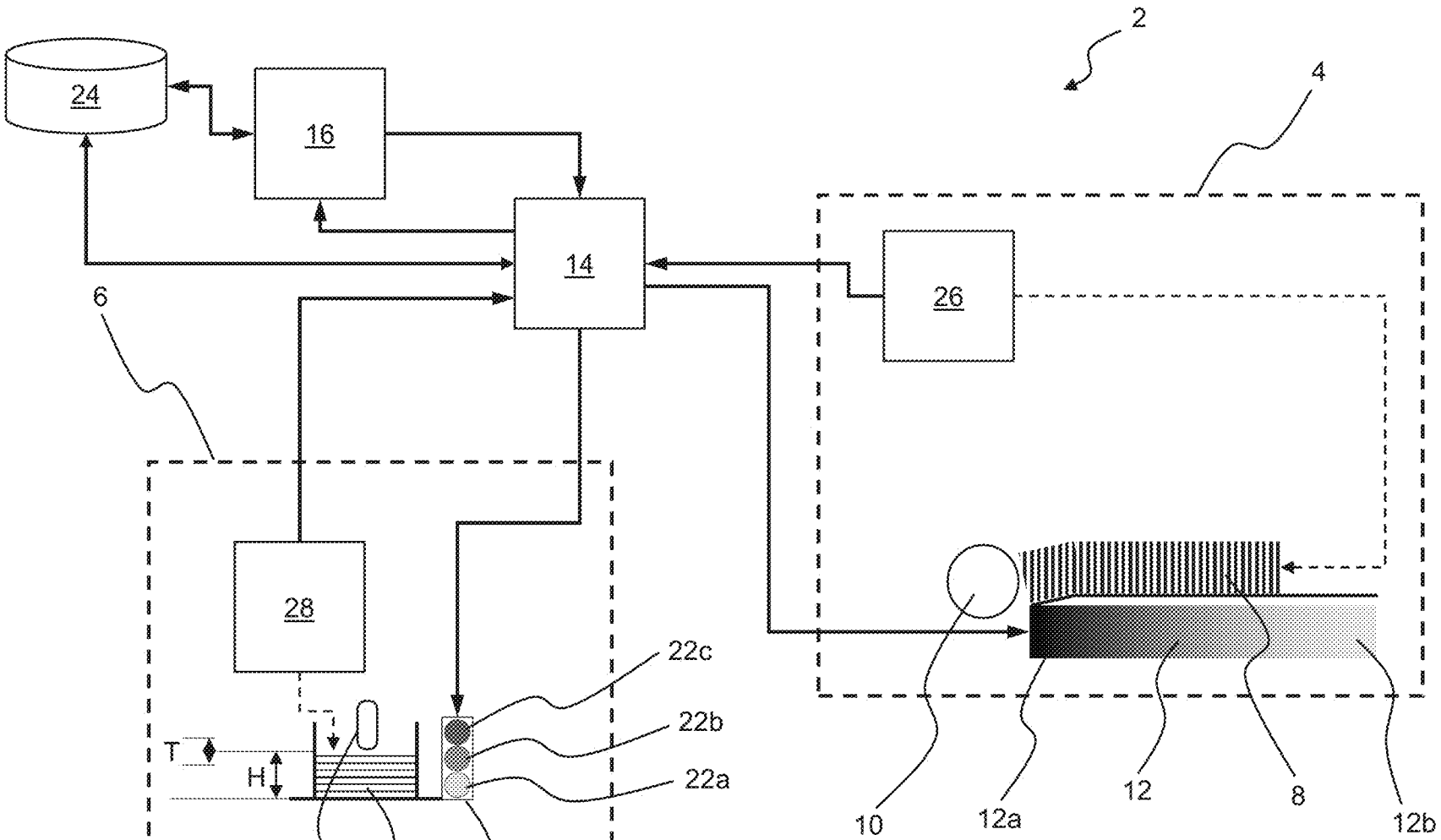
FIG. 2 shows a schematic diagram, corresponding to a second embodiment, of essential components of a packaging machine according to the disclosure.

The embodiment according to FIG. 2 is based on the embodiment according to FIG. 1, so that the description and reference numbers given above apply analogously.

The packaging machine 2 according to FIG. 2 also comprises a database 24, which communicates with the input device 16 and/or the control unit 14. In the database 24, process parameters and empirical values can be stored, which can be called up by the control unit 14 and used to adapt the optical marking in question. Via the input device 16, an operator can select process parameters or enter process parameters and empirical values and store them in the data base 24.

The packaging machine 2 also comprises, independently of the database 24, a first sensor 26, which communicates with the control unit 14 and which is configured to determine a first process parameter and to provide it to the control unit 14. In this exemplary embodiment, the first sensor 26 is assigned to the first supply unit 4 and serves to determine the packing density of the packaging materials 8 in the first supply unit 4.

The packaging machine 2 can also comprises a second sensor 28, which communicates with the control unit 14 and which is configured to determine a second process parameter and to make it available to the control unit 14. In this exemplary embodiment, the second sensor 28 is assigned to the second supply unit 6 and determines the fill level or the height H of the package goods 18 in the second supply unit 6.

The sensors 26, 28 can therefore be used to detect a process parameter independent of the fill level for the purpose of adapting the at least one optical marking or to provide the control unit 14 with information on the fill level of the supply unit 4, 6 in question for the purpose of actuating the at least one optical marking.

Instead of the sensors 26, 28 or in addition to them, it would also be possible to provide other sensors for determining additional process parameters which do not necessarily have to be assigned to a supply unit.

The invention claimed is:

1. A packaging machine for packaging package goods in packaging materials, the packaging machine comprising:

a supply unit for holding and providing a plurality of package goods or packaging materials;

a display device assigned to the supply unit, wherein the display device is adapted to display at least one optical marking which is different from an alphanumeric display, wherein the at least one optical marking is indicative of a fill level of the supply unit, and wherein the at least one optical marking is variably adaptable as a function of at least one process parameter different from the fill level in a way that an assignment of the at least one optical marking to a certain degree of the fill level of the supply unit is changeable; and a control unit, which communicates with the display device and which is configured to adapt the at least one optical marking as a function of the at least one process parameter different from the fill level.

2. The packaging machine according to claim 1, wherein the at least one optical marking is a color marking, wherein the color of the color marking or the color progression of the color marking is adaptable as a function of the at least one process parameter different from the fill level.

3. The packaging machine according to claim 1, wherein the display device is arranged on or in the supply unit.

4. The packaging machine according to claim 3, wherein the display device is configured as a light-emitting strip, which comprises a plurality of individually actuatable light-emitting fields.

5. The packaging machine according to claim 1, wherein the display device is arranged along the plurality of package goods or packaging materials in the supply unit.

6. The packaging machine according to claim 5, wherein the display device is partially covered by the plurality of package goods or packaging materials.

7. The packaging machine according to claim 1, wherein the at least one optical marking is projected onto the plurality of package goods or packaging materials.

8. The packaging machine according to claim 1, wherein the display device is configured as an optical signal device on the supply unit.

9. The packaging machine according to claim 1, wherein the at least one process parameter different from the fill level corresponds to a format of the plurality of package goods or packaging materials and/or to a packing density of the plurality of package goods or packaging materials in the supply unit; and wherein the packaging machine further comprises a sensor, which communicates with the control unit and which is configured to determine the process parameter different from the fill level;

wherein the control unit is configured to adapt the at least one optical marking as a function of the determined process parameter different from the fill level.

10. A method for operating a packaging machine for packaging package goods in packaging materials, the method comprising the steps of:

(a) providing a plurality of package goods or packaging materials in a supply unit of the packaging machine;

(b) displaying, by means of a display device, at least one optical marking which is different from an alphanumeric display, wherein the at least one optical marking is indicative of a fill level of the supply unit, and wherein the at least one optical marking is variably adaptable as a function of at least one process parameter different from the fill level in a way that an assignment of the optical marking to a certain degree of the fill level of the supply unit is changeable;

(c) determining the at least one process parameter different from the fill level; and (d) adapting the at least one optical marking as a function of the at least one process parameter different from the fill level.

11. The method according to claim 10, wherein step (c) comprises:

detecting the at least one process parameter different from the fill level by means of a sensor; or calling up the at least one process parameter different from the fill level from a database; or entering the at least one process parameter different from the fill level by way of an input device.

12. The method according to claim 10, wherein step (d) comprises changing the assignment of the optical marking to the certain degree of the fill level.

13. The method according to claim 10, wherein the at least one process parameter different from the fill level corresponds to a batch size, to a number of package goods or packaging materials still needed for a batch, to a format of the plurality of package goods or packaging materials, to a packing density of the plurality of package goods or packaging materials in the supply unit, to an output rate of the packaging machine, and/or to an optimum operating point of a removal device assigned to the supply unit.

14. The method according to claim 10, further comprising:

determining, in step (c), a first number of package goods or packaging materials corresponding to a holding capacity of the supply unit;

determining, in step (c), a second number of package goods or packaging materials corresponding to a number of package goods or packaging materials still needed for the batch being processed by the packaging machine at the time in question;

comparing the first number of package goods or packaging materials with the second number of package goods or packaging materials; and adapting the at least one optical marking when the second number of package goods or packaging materials is less than or equal to the first number of package goods or packaging materials.

15. The method according to claim 10, further comprising:

determining, in step (c), an optimum operating point of a removal device assigned to the supply unit; and adapting, in step (d), the at least one optical marking by assigning the optical marking to the determined optimum operating point.

* * * * *